US008894512B2

(12) United States Patent
Gilman

(10) Patent No.: US 8,894,512 B2
(45) Date of Patent: Nov. 25, 2014

(54) FUMBLE CAUSING TRAINING DEVICE FOR FOOTBALL

(75) Inventor: Neil F. Gilman, South Glastonbury, CT (US)

(73) Assignee: Marty Gilman, Inc., Gilman, CT (US)

( * ) Notice: Subject to any disclaimer, the term of this patent is extended or adjusted under 35 U.S.C. 154(b) by 321 days.

(21) Appl. No.: 13/226,451

(22) Filed: Sep. 6, 2011

(65) Prior Publication Data

US 2013/0059682 A1 Mar. 7, 2013

(51) Int. Cl.

| | |
|---|---|
| ***A63B 69/00*** | (2006.01) |
| ***A63B 69/20*** | (2006.01) |
| ***A63B 71/02*** | (2006.01) |
| *A63B 21/02* | (2006.01) |
| *A63B 21/16* | (2006.01) |

(52) U.S. Cl.

CPC ..... *A63B 69/002* (2013.01); *A63B 69/20* (2013.01); *A63B 71/023* (2013.01); *A63B 69/0091* (2013.01); *A63B 21/023* (2013.01); *A63B 2243/007* (2013.01); *A63B 2021/169* (2013.01)

USPC ..... 473/438

(58) Field of Classification Search

USPC ..... 473/438, 457, 451, 458, 422; 482/89, 482/91; 428/11; 305/146; 248/118.1; D21/798; 128/878; 403/42; 52/295

See application file for complete search history.

(56) References Cited

U.S. PATENT DOCUMENTS

| | | | | | |
|---|---|---|---|---|---|
| 547,342 | A | * | 10/1895 | Foster | 482/87 |
| 547,731 | A | * | 10/1895 | MacLearn | 482/85 |
| 565,747 | A | * | 8/1896 | Hawthorne et al. | 482/87 |
| 689,344 | A | * | 12/1901 | Yoerger et al. | 482/87 |
| 732,096 | A | * | 6/1903 | Maxwell | 482/87 |
| 925,342 | A | * | 6/1909 | Johnson | 482/90 |
| 1,007,311 | A | * | 10/1911 | Patterson | 482/87 |
| 1,020,367 | A | * | 3/1912 | Pons | 482/85 |
| 2,435,864 | A | * | 2/1948 | Adams | 482/90 |
| 3,022,072 | A | * | 2/1962 | Zinnow | 482/90 |
| 3,311,333 | A | * | 3/1967 | Galloway | 52/295 |
| 3,533,890 | A | * | 10/1970 | Nesbit | 428/11 |
| 3,662,482 | A | * | 5/1972 | Sarkisian | 40/602 |
| 3,999,776 | A | * | 12/1976 | Betts, Sr. | 280/851 |
| 4,377,283 | A | * | 3/1983 | Mahoney | 473/485 |
| 4,463,951 | A | * | 8/1984 | Kumasaka et al. | 473/601 |
| 5,913,778 | A | * | 6/1999 | Hying et al. | 52/40 |
| 6,398,697 | B1 | * | 6/2002 | Nichols, Jr. | 482/87 |
| 6,451,393 | B1 | * | 9/2002 | Ploetz | 428/34.1 |
| 6,736,764 | B1 | * | 5/2004 | Kapustka | 482/83 |

(Continued)

OTHER PUBLICATIONS

Webpage download, arizonaresponsesystems, 2010, www.arizonaresponsesystems.com/notes/notesfinish/wood/pagewood.shtml, 2 pages.*

*Primary Examiner* — Gene Kim
*Assistant Examiner* — M Chambers
(74) *Attorney, Agent, or Firm* — Brian R. Pollack; Day Pitney LLP

(57) ABSTRACT

A training device is disclosed, which includes a ball and a biasing member, where a distal portion of the ball is connected to a proximate end of the biasing member. A support member is connected to a distal end of the biasing member, where the support member is adapted for being connected to a stationary support structure. From this configuration, the ball is capable of deflecting from an initial, rest configuration when the ball is perturbed by clubbing, punching and/or chopping, and rapidly returning to the rest configuration after the perturbation.

13 Claims, 3 Drawing Sheets

(56) References Cited

U.S. PATENT DOCUMENTS

| | | | | |
|---|---|---|---|---|
| 6,786,854 | B1 * | 9/2004 | Hsu | 482/83 |
| 7,001,173 | B1 * | 2/2006 | Chu | 425/589 |
| 7,214,169 | B1 * | 5/2007 | Clayton | 482/88 |
| 7,651,447 | B2 * | 1/2010 | Yang | 482/85 |
| 7,766,799 | B1 * | 8/2010 | Chen | 482/85 |
| 8,617,034 | B2 * | 12/2013 | Eem | 482/83 |
| 8,641,583 | B2 * | 2/2014 | Chen | 482/83 |
| 2002/0165047 | A1 * | 11/2002 | Nunnely et al. | 473/438 |
| 2004/0209743 | A1 * | 10/2004 | Perez | 482/83 |
| 2013/0059682 | A1 * | 3/2013 | Gilman | 473/438 |

* cited by examiner

FOOTBALL
FOAM
12
40
10
20
13
24
14
6"
18
16
SECTION THRU ASSEMBLED
FUMBLE MAKER
1/4 SCALE

3/16" ANCHOR HOOK
42
22
3/4"Φ x 7 1/2" THREADED ROD
20
24
23
35
CUSTOM 1/2"Φ NUT
30
26
1/2"Φ NUT
MILLED ALUM. SPACER
34
32
36
25
EXPLODED VIEW
1/4 SCALE
1 1/2"Φ x 6" LONG SPRING
14
PL6x6x1/4" W/ 4-1/2"Φ HOLES
18
72
16
69
70
48

58
66
1/2"Φ TYP
71
16
68
60
48
6"
3"
62
56
54
64
BASE PLATE
1/4 SCALE

ATTACHING TO STUD WALLS

1/8 SCALE

ATTACHING TO WEIGHT RACK

1/8 SCALE

ATTACHING TO MASONRY WALLS

1/8 SCALE

FUMBLE CAUSING TRAINING DEVICE FOR FOOTBALL

BACKGROUND

1. Field of the Disclosed Embodiments

The disclosed embodiments relate to a training device which enables football players the opportunity to practice a fumble causing technique called "stripping the football."

2. Background of the Disclosed Embodiments

Various systems exist for assisting in training athletes of all ages in American football. Example training systems include: inflated footballs of various sizes, from junior to regulation; a solid football mounted to a stick or, alternatively, connected to a string, simulating the "snap" of a football; a "whiffle" football with an elastic cord attachment for throwing and catching practice; and a "heavy football," that is, a weighted football, filled with water or metal pellets, for long "snapper" practice.

One football technique for which practice is sought is "stripping the football," causing an opposing teammate to "fumble." Stripping practice, using proper training systems, is an essential part of the mental and physical football game. Defensive coaches constantly talk about "see the football-cause a fumble" and "increasing take-aways," that is, increase the number of fumbles. Coaches preach about such goals in team meetings, during video breakdown sessions, and during strength and conditioning sessions. Coaches believe in repetitive stripping drills to make certain techniques a habit.

A common training system for stripping a ball includes several components. One component is a solid or inflated football with Velcro™, re-connectable tape, sewn to its side. The other component is a "dummy" or foam filled "arm," to which the football can stick via the tape. These components provide "stripping" practice because when the ball is hit, it separates from the dummy or arm and becomes loose. Relying on a stand-up or pop-up dummy, or on artificial arms can be a challenge in a training environment. In addition, relying on tape to hold the football to the system, such as with the dummy and artificial arms, can be a further challenge for a training environment.

SUMMARY OF THE DISCLOSED EMBODIMENTS

A training system for football stripping is provided that can be mounted to a wall, a door, a table or a rack in the weight-room. With such a system, a football player can come out of a team meeting, a video breakdown session, or a strength and conditioning workout, and practice "clubbing", "punching" or "chopping" the football to create a fumble.

BRIEF DESCRIPTION OF THE FIGURES

Certain embodiments will be described through the use of the accompanying drawings, which are not to be considered as limiting, and in which.

DETAILED DESCRIPTION OF THE DISCLOSED EMBODIMENTS

Figure 1:
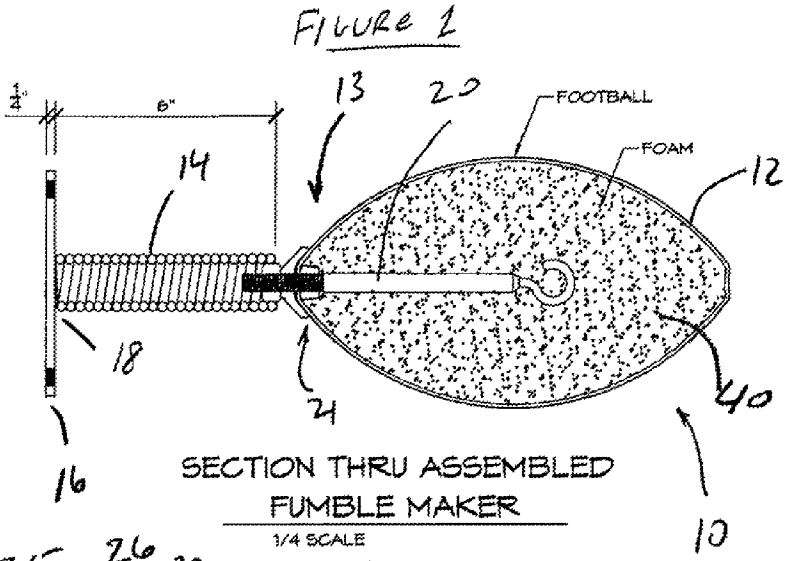
FIG. 1 is a cross sectional view of the disclosed football training device.
Figure 2:
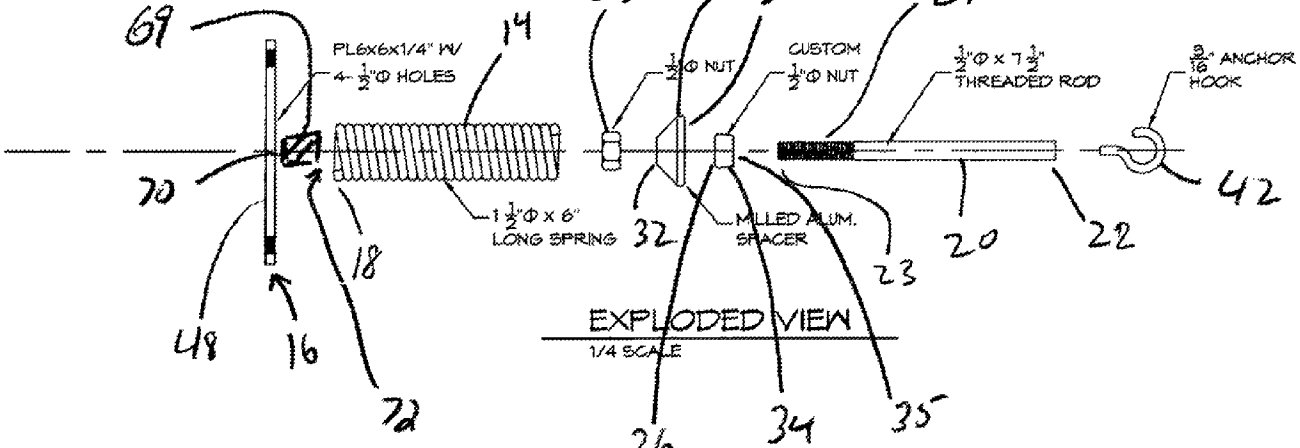
FIG. 2 is an exploded view of components of the disclosed football training device.
Figure 3:
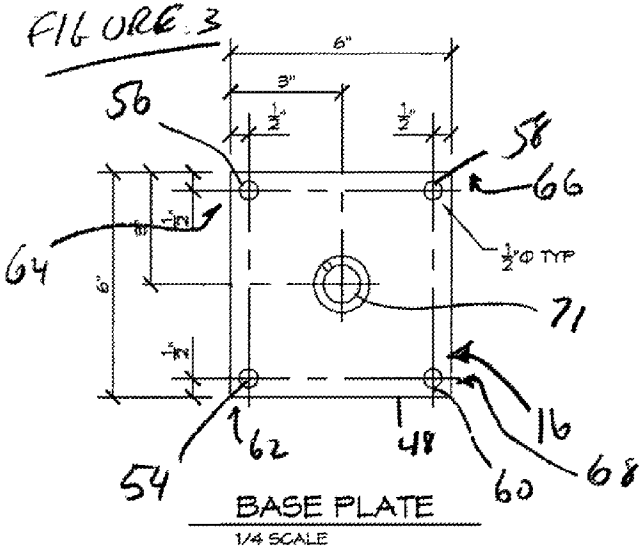
FIG. 3 is an illustration of a component of the disclosed football training device.

A training device 10 is disclosed in the figures. The device includes a ball 12 and a biasing member 14, where a distal portion 13 of the ball 12 is connected to a proximate end of the biasing member 14. In the figures, the relative placement of "proximate" and "distal" is illustrate right to left. However, other relative directional relationships are acceptable.

A support member 16 is connected to a distal end 18 of the biasing member 14, where the support member 16 is adapted for being connected to a stationary support structure 19. From this configuration, the ball 12 is capable of deflecting from an initial, rest configuration when the ball 12 is perturbed by clubbing, punching and/or chopping, and rapidly returning to the rest configuration, substantially immediately after the perturbation.

As illustrated, the ball 12 is oblong shaped, and, in particular, is a football. The illustrated football is intended to depict a regulation size football, but other sizes are acceptable, such as a junior size. In addition, other ball shapes could be utilized without departing from the scope of the disclosed embodiments.

The biasing member 14 is a spring and, more specifically, a coil spring. In addition, the illustrated coil spring is a tension spring having an inch and a half diameter and is six inches long. The spring is a "heavy" spring having damping qualities. From the selection of the spring, the system can be over-damped, under-damped or critically damped, such that ball 12 experiences minimal or substantially no repeated undulations following the perturbation. Such motion control over the ball 12 enables rapid and repeated athletic training.

The ball 12 is connected to the spring 14 via a rod 20 extending therebetween. The rod 20 is illustrated as a half inch diameter steel rod which is seven and a half inches long. The rod 20 serves to facilitate a stable and reliable connection between the ball 12 and the spring 14, preventing the ball from breaking away during use.

As illustrated in the figures, the ball 12 is filled with polyurethane foam 40. In addition, the proximate end 22 of the rod 20 extends into the ball and has an anchoring member 42, illustrated as a hook, which is a three-sixteenth of an inch anchor, for securing the rod 20 to the foam 40. As can be appreciated, the rod 20 is threaded at its proximate end to receive the male threaded anchor. Further, as illustrated, the seven and a half inch long rod is long enough to position the anchor substantially halfway into the ball 12.

The disclosure will now address, more specifically, the connection between the rod and the spring at the distal portion of the ball. The ball 12 has an opening 21, which is illustrated as a three-quarter inch opening, allowing the rod 20 to pass therethrough along a rod-axial direction. The opening/hole 21 can be drilled into the apex of the football during manufacturing. A proximate end 22 of the rod 20 extends into the ball opening 21 and a distal end 23 of the rod 20 extends into the proximate end 15 of the spring 14. As can be appreciated, this configuration bridges the ball 12 with the spring 14.

The distal end 23 of the rod 20 has a threaded portion 24, and the proximate end 15 of the spring 14 includes a nut 25, illustrated as a half inch steel nut 25, fixed thereto, such as by welding, for receiving the threaded portion 24 of the rod 20.

From this connection, the rod 20 will not fall away from the spring but instead forms an essentially integrated connection.

A spacer 26, milled from one and a half inch aluminum bar stock, is threaded to the threaded portion of the rod 20. A distal surface 32 of the spacer 26 is disposed against the nut and a proximate surface 30 of the spacer 26 is disposed against the exterior of the distal portion 13 of the ball 12. In other words, the spacer 26 is threaded so that it is positioned tightly against the ball 12. From this configuration, the ball opening 21 is capped from the ball exterior side.

The proximate surface 30 of the spacer 26 is contoured to provide a substantially complementary seating to the exterior of the distal portion 13 of the ball 12 disposed about the rod 20. As the spacer 26 is substantially more rigid than the ball 12, this complementary shape prevents unwanted deformation of the ball 12 in the area of the spacer 26.

A bushing 34, illustrated as a three-quarter-inch steel nut, which is substantially the same as the diameter of the ball opening 21, is threaded to the threaded portion 24 of the rod 20. A proximate surface 35 of the bushing 34 faces the interior of the ball 12 and a distal surface 36 of the bushing faces the exterior of the ball and is substantially planar with the opening 21 of the ball 12.

The distal surface 36 of the bushing 34 is contoured to provide a complementary seating to the proximate surface 30 of the spacer 26. From this complimentary configuration, the spacer 26 has a base to press against during assembly of the training device 10, enabling a tightly, and therefore reliably, threaded connection between the spacer 26 and the ball 12.

Figure 7:
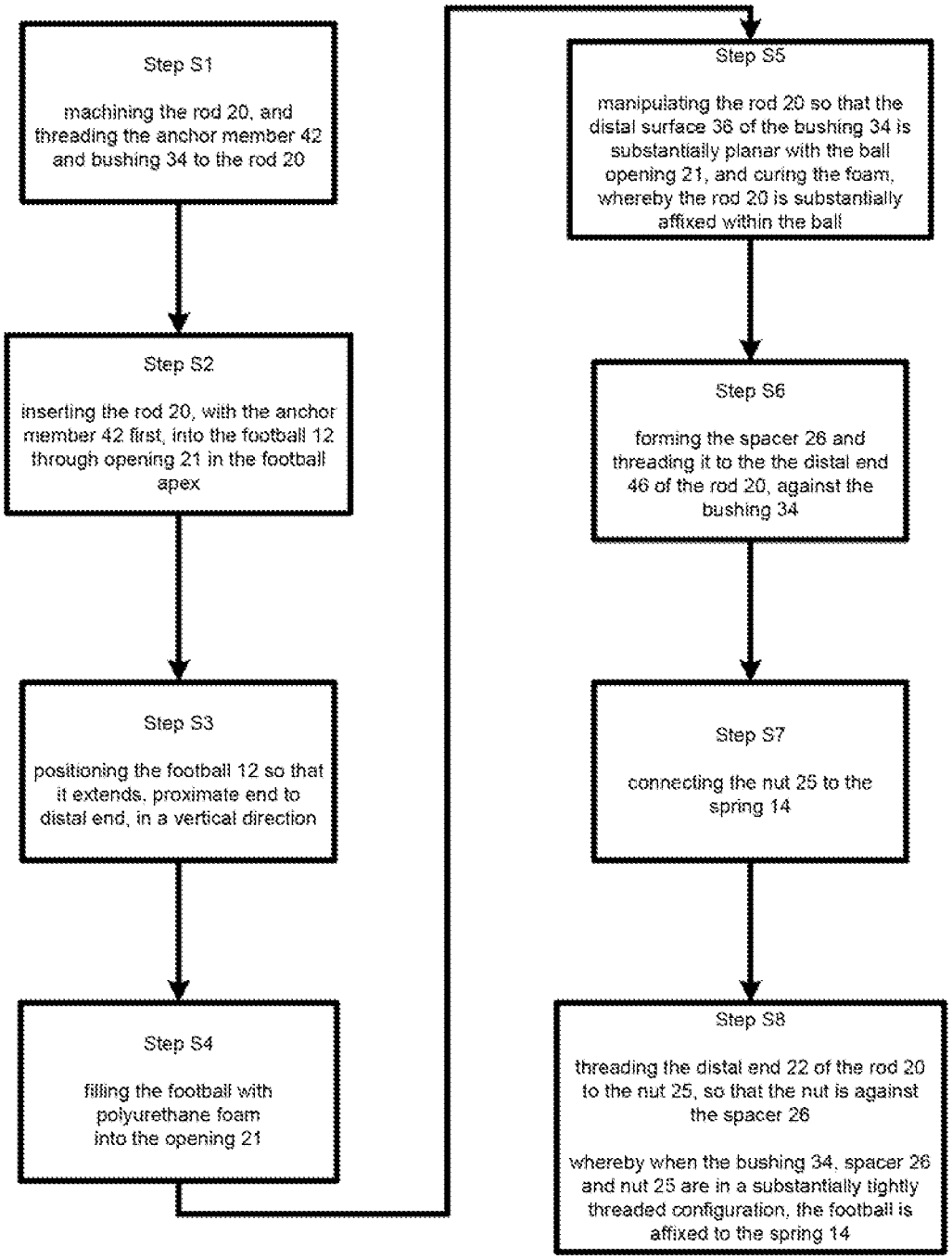
FIG. 7 is an illustration of a method of manufacturing the football training device.

Turning momentarily to the manufacturing process illustrated in FIG. 7, the process includes a first step, Step S1, of machining the rod 20, and threading the anchor member 42 and bushing 34 to the rod 20 so as to form an anchor rod. The second step, Step S2, includes inserting the rod 20, anchor member 42 first, into the football 12 through the previously created opening 21 in the football apex.

For inserting the rod 20 into the ball 12, a guide tool (not illustrated) which can be used includes a guide cord, manufactured from braided nylon cord, which is directly tethered to a three-quarters of an inch outer diameter plug, to which a three-eighths of an inch fully male-threaded rod is threaded or otherwise fastened. The three-eighths of an inch diameter male threaded guide tool rod is screwed into the top of the anchor rod 20 which is drilled and tapped to receive the guide tool rod.

A third step, Step S3, includes positioning the football 12, for example, in a jig (not illustrated), so that the opening 21 faces vertically upward. At this time, the guide tool holds the rod 20 from falling into the vertically oriented football 12.

The fourth manufacturing step, Step S4, is filling the football 12 with polyurethane foam, such as through a funnel (not illustrated), via the opening 21. The fifth step, Step S5, is manipulating the rod 20 using the guide tool, so that the distal surface 36 of the bushing 34 is substantially planar with the ball opening 21. In this configuration, the hole 21 is "plugged" and the foam is allowed to cure, and, due to the anchor member 42, the rod 20 permanently fixed within the football 12. Once cured, the guide tool is removed.

The manufacturing process includes a sixth step, Step S6, of forming the spacer 26 and threading it to the distal end 22 of the rod 20, against the bushing 34. A seventh step, Step S7, is connecting the nut 25 to the spring 14 via, for example, welding. An eighth step, Step S8, is threading the distal end 22 of the rod 20 to the nut 25, so that the nut 25 is against the spacer 26. Once the bushing 34, spacer 26 and nut 25 are in a substantially tightly threaded configuration, the football is essentially integrally affixed to the spring 14.

Figure 4:
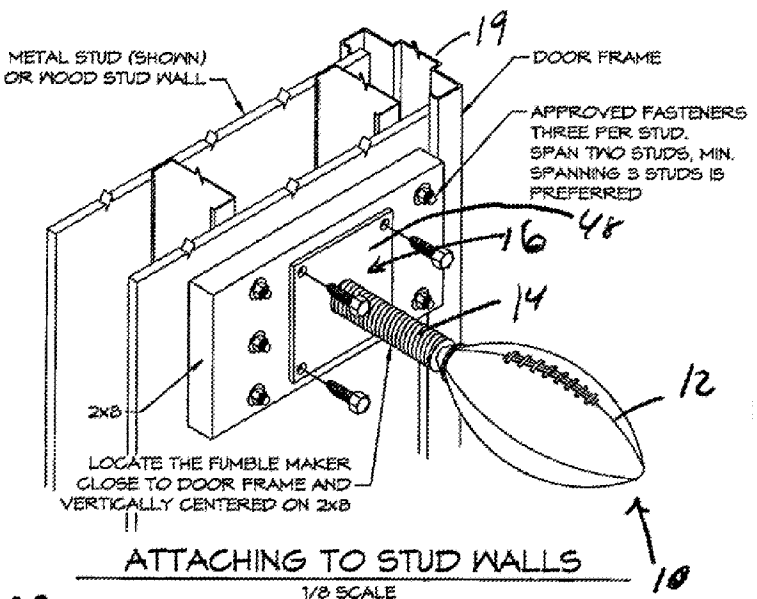
FIG. 4 is an illustration of the football training device installed on a wall.
Figure 6:
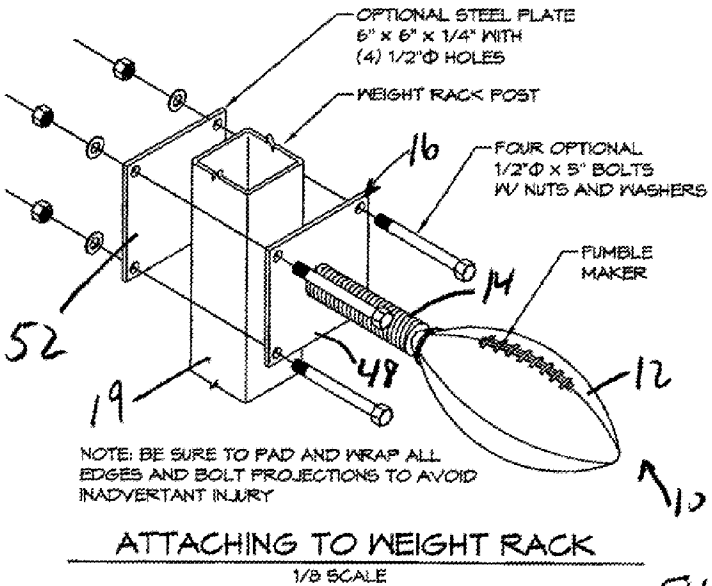
FIG. 6 is an illustration of the football training device installed on a rack.

Turning back to the device configuration, the disclosed support member 16 includes a plate 48, illustrated as a six inch square by quarter inch thick steel plate. The front-view plane of the plate 48 is perpendicular to a long axis of the spring 14. The plate 48 is capable of being connected to a substantially planar portion of the support structure 19. Examples of contemplated support structures 19 include doors, rigid walls, such as block walls (FIG. 5), plates on a wall which extend between support beams and studs (FIG. 4), plates between free standing supports such as weight-racks, etc. That is, the plate should be connected to a structure which will not give under the stress and strain from use of the device 10.

Figure 5:
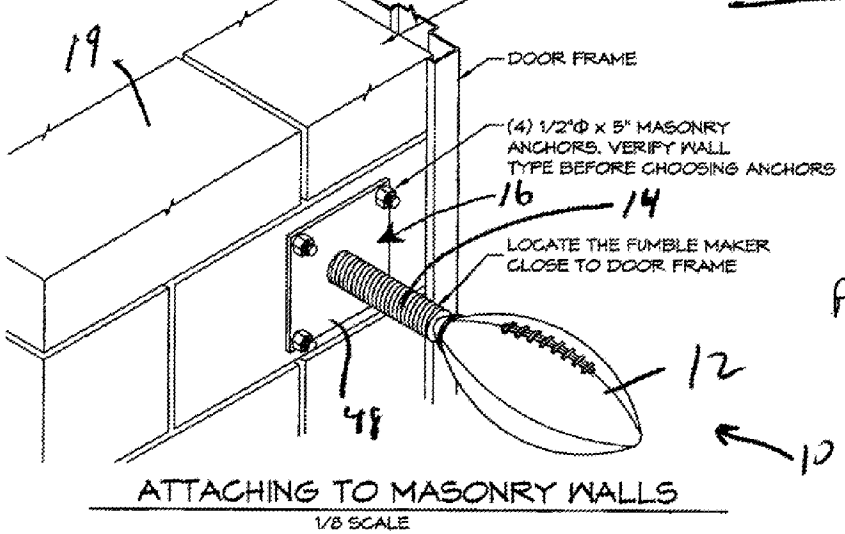
FIG. 5 is an illustration of the football training device installed on a block wall.

As illustrated in FIG. 5, the aforementioned plate 48 is a proximate plate, and the device includes a distal plate 52. The plane of the distal plate 52 is substantially parallel to the proximate plate 48. The plates 48, 52 are capable of sandwiching a support structure 19 there-between for supporting the device 10. Types of support structures which are considered include free standing gym racks, cantilevered posts, etc.

The plates 48, 52 have at least one opening 54, illustrated as a half inch diameter opening. The opening 54 is used for receiving a respective at least one bolt and securing the plates 48, 52 to or about a support structure 19. As illustrated, the at least one opening 54 includes a bank of four openings 54-60 on each plate, with one of the openings disposed at each of four corners of the plate 62-68. In the illustration, the openings are five inches on center for the six inch-square plate.

The support member 16 includes a second rod 69, serving as a support rod, which is illustrated as a one inch diameter rod, that is half an inch long, and connected at its distal end 70 to a center 71 of the proximate plate 48. The distal end 18 of the spring 14 is connected, via welding, to at least the proximate end 72 of the second rod 50 for supporting the spring 14 at the plate 48. With this connection, the spring is integrated to the plate and will not separate therefrom under loading stress.

It is within the scope of the disclosed embodiments to have a system that includes a support structure 19, such as a weight-rack, coupled with the training device. In such a system, the plates 48, 52 are secured about a portion of the support structure 19, such as to a weight-rack post, for securing the training device 10 thereto. That is, the disclosed embodiments are not limited to the football training device 10, removed from its typical application.

In sum, the disclosed embodiments relate to a football training device which includes a polyurethane foam filled football, with an anchor rod that is augured into the football. At the end of the rod is a threaded section that screws into a coil spring. In turn, the coil spring is threaded into a bushing that is welded to a steel plate. As indicated, the coil tension spring is strong enough to hold the football at angle perpendicular to the ground without bending; is strong enough to return the football to a perpendicular position after being clubbed, chopped or punched; and is not so stiff that it requires an unnatural amount of force to deflect it when performing "clubbing", "chopping" or "punching" football techniques.

As further disclosed, the single steel plate can be used as a mounting plate for a wall, door or table. A double steel plate can be used as a mounting bracket with four locking bolts for a square or rectangular rack of the type typically found in a weight-room.

Accordingly, the disclosed embodiments enable the practice of ball stripping without relying on a stand-up or pop-up dummy, or artificial arms. In addition, tape is not relied upon to hold the football to the system. That is, the disclosed embodiments provide a training system for football stripping that can be mounted to a wall, a door, a table or a rack in the weight-room. With such a system, a football player can come out of a team meeting, a video breakdown session, or a strength and conditioning workout, and practice "clubbing", "punching" or "chopping" the football to create a fumble.

The disclosed embodiments may be configured in other specific forms without departing from the spirit or essential characteristics identified herein. The embodiments are in all respects only as illustrative and not as restrictive. The scope of the embodiments is, therefore, indicated by the appended claims and their combination in whole or in part rather than by the foregoing description. All changes that come within the meaning and range of equivalency of the claims are to be embraced within their scope.

I claim:

1. A fumble training device for football training, comprising:

a) a first portion resembling a football, having a proximal portion and a distal portion, filed with a resilient material;

b) a support rod having a proximal end and a distal end; the proximal end of the support rod extending into the distal end portion of the first portion but not entirely through the first portion to its proximal end, the support rod being surrounded by the resilient material along at least a portion of its length, the support rod further including an anchor disposed thereon, wherein the anchor is a hook, the anchor hook being embedded in and secured to the resilient material to prevent the support rod from being pulled out of the first portion;

c) a tension coil spring comprising a plurality of turns and haying a proximal end and a distal portion, the proximal end of the tension coil spring being attached to the support rod, wherein the turns of the coil spring are in mutual contact when said tension coil spring is in a relaxed, horizontal position, and wherein said coil spring is configured to hold said support rod and said ball at a horizontal angle when the coil spring is in its relaxed, horizontal position; and wherein the coil tension spring is strong enough to hold the football at angle perpendicular to the ground without bending; is strong enough to return the football to a perpendicular position after being clubbed, chopped or punched; and is not so stiff that it requires an unnatural amount of force to deflect it when performing "clubbing", "chopping" or "punching" football techniques; and d) a stationary vertical support configured to maintain said tension coil spring, said support rod, and said first portion at a horizontal angle, perpendicular to said stationary vertical support.

2. The fumble training device of claim 1, wherein the distal end of the support rod has a threaded portion, and further wherein the proximal region of the spring includes a nut affixed thereto for receiving the threaded portion of the support rod.

3. The fumble training device of claim 2, further comprising a spacer threaded to the threaded portion of the support rod, wherein a distal surface of the spacer is disposed against the nut and a proximal surface of the spacer is disposed against an exterior area of the distal portion.

4. The fumble training device of claim 3, wherein the proximal surface of the spacer is concavely contoured to complement a concave surface of the first portion.

5. The fumble training device of claim 1, further comprising a mount attached to the distal portion of the stationary vertical support for mounting the fumble training device to the stationary vertical support, the mount including a base mounting plate configured for placement against the stationary vertical support, wherein the base mounting plate is disposed along a direction that is generally perpendicular to an axis defined through a central portion of the first portion, the support rod and the tension coil spring, and wherein the tension coil spring is sufficiently stiff such that the first portion experiences substantially no repeated undulations following a perturbation.

6. The fumble training device of claim 5, wherein said stationary vertical support is a structural vertical support beam.

7. The fumble training device of claim 5, wherein said stationary vertical support is a door.

8. The fumble training device of claim 5, wherein said stationary vertical support is a rigid wall.

9. The fumble training device of claim 5, wherein said stationary vertical support is a free-standing rack.

10. The fumble training device of claim 1, wherein the mount defines at least one opening therethrough for receiving at least one fastener for mounting the device to the vertical surface.

11. The fumble training device of claim 1, further comprising a second support rod having a proximal end and a distal end, the distal end of the second rod being connected to the mount, and the proximal end of the second rod being disposed within a distal region of the tension coil spring.

12. The fumble training device of claim 1, wherein the resilient material includes polyurethane foam.

13. The fumble training device of claim 1, wherein the support rod extends into the first portion for about half of the length of the first portion.

* * * * *